US006030045A

United States Patent [19]

Hoshino

[11] Patent Number: 6,030,045

[45] Date of Patent: Feb. 29, 2000

[54] HOLDING STRUCTURE FOR A POST FOR A DRUM CHAIR

[75] Inventor: Yoshihiro Hoshino, Nagoya, Japan

[73] Assignee: Hoshino Gakki Co., Ltd., Nagoya, Japan

[21] Appl. No.: 09/181,200

[22] Filed: Oct. 28, 1998

[30] Foreign Application Priority Data

Jul. 13, 1998 [JP] Japan ..... 10-005178

[51] Int. Cl.[7] ..... A47C 9/08

[52] U.S. Cl. ..... 297/461; 297/344.12; 248/425; 248/166; 248/170

[58] Field of Search ..... 297/461, 344.12; 248/425, 166, 170

[56] References Cited

U.S. PATENT DOCUMENTS

| | | | |
|---|---|---|---|
| 3,262,406 | 7/1966 | Nickolaisen | 297/461 |
| 3,593,954 | 7/1971 | Ritchie et al. | 248/425 X |
| 4,101,163 | 7/1978 | Morin | 297/461 X |
| 5,439,269 | 8/1995 | Cheng | 297/461 X |
| 5,524,968 | 6/1996 | Stoltz | 297/344.12 X |
| 5,738,326 | 4/1998 | Liao | 297/461 X |
| 5,927,810 | 7/1999 | Liao | 297/344.12 |

*Primary Examiner*—Peter M. Cuomo
*Assistant Examiner*—Rodney B. White
*Attorney, Agent, or Firm*—Ostrolenk, Faber, Gerb & Soffen, LLP

[57] ABSTRACT

A holding structure for an upper post which supports a seat of a chair, such as a drum chair, in order to permit the seat to be rotated and preventing its undesired rotation, without loosening of the seat. The underside of the seat plate carries a holder having an accommodating part and a tightening part which are screw connected to clamp them against the top end region of the upper post. A synthetic resin compressive member surrounds the top end region of the post and includes a radially projecting flange extending between the accommodating and tightening parts for preventing rotation of the compressive member with respect to the accommodating part while permitting the seat to be rotated with respect to the post. The compressive member has a radial cut forming a split ring which are squeezed together as the compressive member is clamped and has a further cut from the first cut extending circumferentially half-way around. The post may comprise an upper and a lower post which are telescopable and legs attached to the lower post.

15 Claims, 8 Drawing Sheets

HOLDING STRUCTURE FOR A POST FOR A DRUM CHAIR

BACKGROUND OF THE INVENTION

The present invention relates to a holding structure for a support post for a drum chair.

THE PRIOR ART

A chair for a drummer comprises a seat with a cushioned body arranged on top of a seat plate and covered with a suitable covering material. The seat is held on an upper post, which is provided at the lower surface of the seat plate. A lower post supports the chair and supports the upper post that supports the seat plate. There are legs on the lower post. The upper post is inserted into the lower post, they are telescoped to a selected total height, and the posts are secured together.

Most known ordinary drum chair seat plates have an installation tube approximately at the center of the underside of the seat plate, into which the top of the upper post is inserted. The top of the upper post is inserted into the installation tube so as to be freely removable therefrom.

A tightening bolt extends through the installation tube to press against the upper post to hold the seat plate to the top of the upper post. However, the tightening bolt between the seat plate and the top post may be loosened by vibrations created or by the movement of the performer while sitting on the seat during use of the drum. The tightening force between the seat and the upper post is not strong enough. As a result, the chair becomes shaky.

To handle this problem, there has in recent years been proposed a chair for a drum 80 having a structure shown in FIGS. 12 and 13. An upper post holder (corresponding to the installation tube) 83 is formed on the underside of the seat plate 82 of the seat 81. The top of the upper post 91 is inserted between a stationary accommodating part 84 of the upper post holder 83 and a movable tightening part 85. The top region of the upper post 91 is clamped and secured between the accommodating part 84 and the tightening part 85 through tightening of the screw 86 on the fixed side at one side of the post and through tightening of the tightening screw 87 on the tightening side at the other side of the post.

The tightening screw 86 on the fixed side is comprised of a bolt 86*a*, which has a head held in the accommodating part 84 of the upper post holding part 83. An adjusting nut 86*b* and a spring 86*c* are constructed such that the clamping position of the tightening part 85 can be determined corresponding to the diameter of the top region of the upper post 91 to be clamped. The seat 81 may also be installed on other apparatus equipped with an upper post with a different diameter.

There is a lower post 92 which has legs 93 attached to it. An adjusting nut 94 permits free adjustment of the length of the upper post 91 in the lower post 92 in a telescoping arrangement. A tightening member 95 secures the upper post 91 in and along the lower post 92.

The above described structure firmly fixes the seat 81 to the upper post 91 and can prevent any shakiness of the drum chair 80 during a performance.

However, the seat 81 is fixed to the top of the upper post 91, making it impossible to rotate the seat. Many performers dislike a seat 81 that is incapable of being rotated during a drum performance. Performers demand a seat 81 that will rotate as the performer moves because a drum set usually includes drums and cymbals, etc. arranged approximately in the shape of an arc around the performer who is seated on the chair 80. The performer tends to face toward the drum or cymbal, etc. which he is using at the time. Performers who set up many drums and cymbals usually desire a seat which rotates to a certain degree.

In this connection, the ideal seat 81 would rotate with some resistance, but without excessive force being exerted by the performer when he moves, to prevent excessive rotation beyond a desired extent, and to prevent rotation when the performer does not rotate.

SUMMARY OF THE INVENTION

It is an object of the present invention to provide a holding structure for a support post for a drum chair which is capable of preventing shakiness that might otherwise be generated due to vibrations created during a performance, which uses a simple structure, and which has a seat that can be rotated as the performer moves.

An upper support post for a drum chair has a top region that is clamped and fixed by an upper post holder on the underside of a seat plate. The upper post may also be secured to a lower post equipped with legs in a manner such that the combined length of the posts can be freely adjusted.

The upper post holder below the seat plate includes an accommodating part for engaging the top region of the upper post from one side, an opposing tightening part for engaging the top region of the upper post from the opposite side and a tightening screw for drawing the parts together, as in the prior art.

Further, a tubular compressive member made of a synthetic resin is attached to the top region of the upper post and that is the part clamped against by the accommodating and tightening parts. That compressive member includes a radial cut extending entirely through the member at one side creating a split ring which enables it to be compressively attached around the surface of the top region of the upper post by the tightening screw.

In a preferred embodiment, an inner bottom part of the tubular shaped compressive member contacts the upper terminal face of the upper post and is integrally held there. A second cut begins at the cut or split ring gap through one side of the tubular shaped compressive member and the second cut goes through the peripheral surface half-way round.

The tubular compressive member may be installed either on the upper post holder or on the upper post.

Other objects and features of the invention are explained below with reference to the attached drawings.

DETAILED DESCRIPTION OF THE INVENTION

Figure 1:
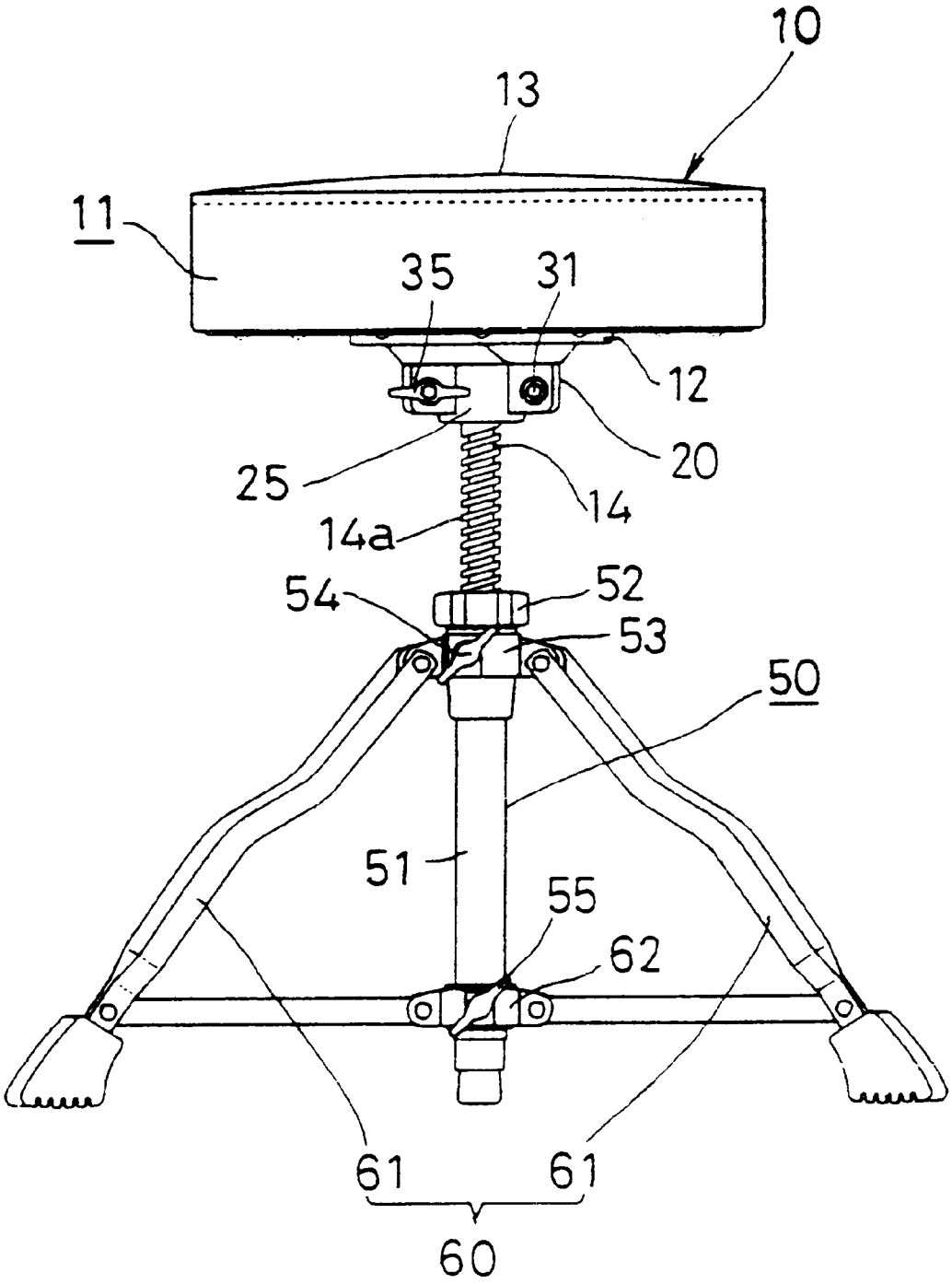
FIG. 1 is a front view of a drum chair having the structure of the invention.

A drum chair for a drummer comprises a seat 11 and a lower post 50 equipped with a leg part 60. A seat plate 12 beneath the seat 11 is firmly fixed to an upper post 14, in a manner such that the seat is not easily loosened even by vibrations produced during a performance or due to movement by the performer. This avoids development of shakiness of the chair. At the same time, the seat 11 is constructed as to be able to properly rotate with movement of a performer.

Figure 2:
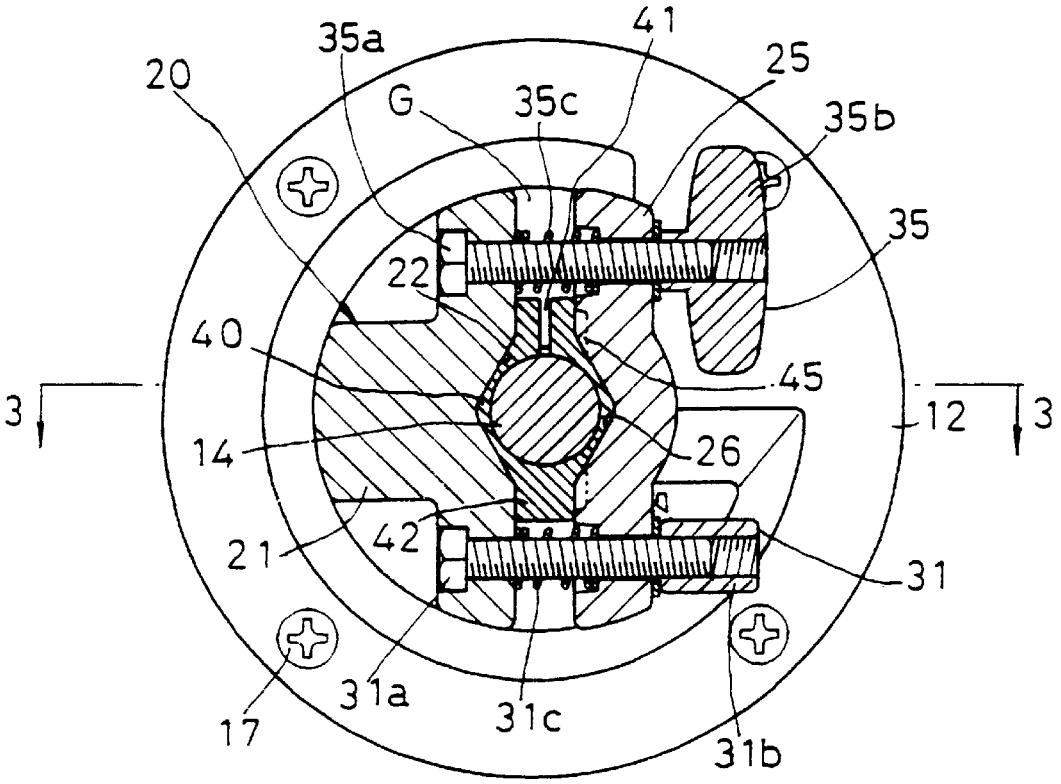
FIG. 2 is a transverse cross-section through the region below the seat and showing an essential part of the invention.
Figure 3:
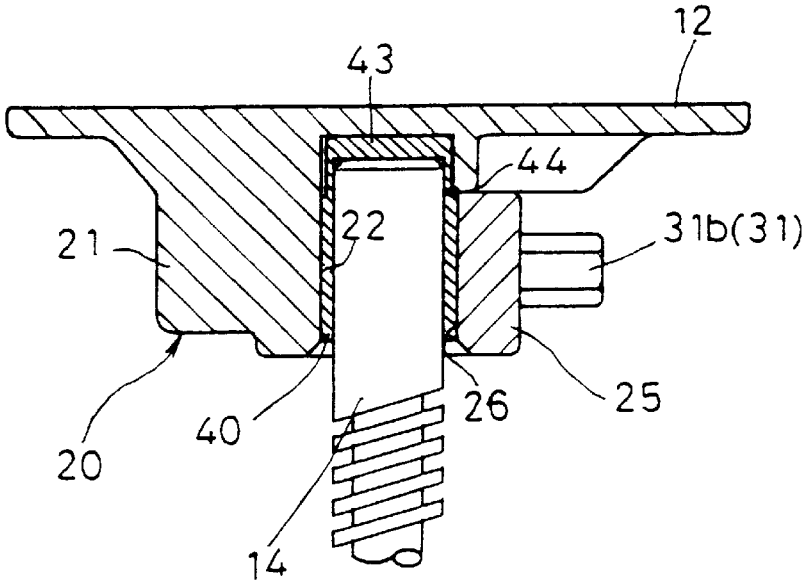
FIG. 3 is a cross-section cut along line 3—3 in FIG. 2.

The seat 11 has a seat surface 13 with a suitable cushion body formed on the surface of the seat plate 12. Installation screws 17 install the seat surface 13 on the seat plate 12. The seat 11 is tightened and secured at the top of the upper post 14 by an upper post holder 20 that is formed or attached beneath the seat plate 12, as seen in FIGS. 2 and 3.

The upper post holder 20 secures the top region of the upper post 14 using a generally tubular shaped compressive member 40. The holder 20 comprises an accommodating part 21 with a groove for receiving the top of the upper post 14 at one side of the post. The accommodating part 21 is generally shaped like a half-cut tube and is on the under side of the seat plate 12. It includes a compressive surface 22 on its inner side that lies along the outer surface of the tubular shaped compressive member 40.

The holder also includes a tightening part 25 with a groove opposed to the first mentioned groove at the other side of the post. The tightening part 25 also has a compressive surface 26 on its inside that lies along the outer surface of the tubular shaped compressive member 40.

A tightening member comprises a tightening screw 31 on the fixed side and at one side of the post and extending between the accommodating and tightening parts, and another tightening screw 35 on the tightening side at the other side of the post and extending between the accommodating and tightening parts. The tightening part is tightened or loosened with respect to the accommodating part 21 by tightening the screw 31 on the fixed side and by tightening the screw 35 on the tightening side.

Figure 4:
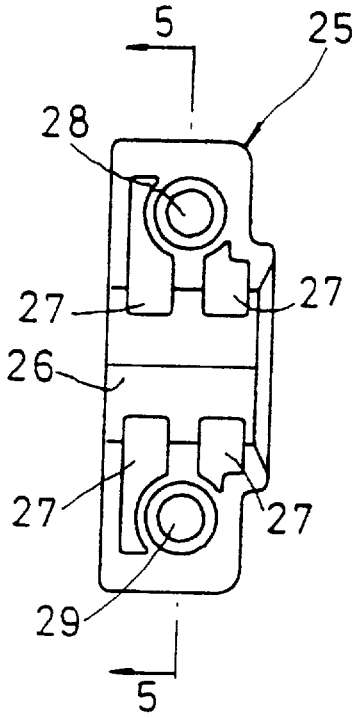
FIG. 4 shows the inner surface side of the tightening part of the upper post holder.
Figure 5:
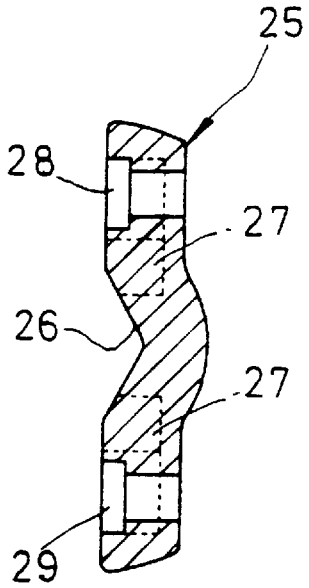
FIG. 5 is a cross-section cut along line 5—5 in FIG. 4.

In this example, there are a suitable number, e.g. four in FIGS. 4 and 5, of concaves 27 on the inner surface of the tightening part 25 for engaging protrusions 45 on the surface of the tubular shaped compressive member 40 described below. There is an insertion hole 28 for the tightening screw 35 on the tightening side and an insertion hole 29 for the tightening screw 31 on the fixed side.

The tightening screw 31 on the fixed side comprises a bolt 31*a* having a head end buried in the accommodating part 21 and an adjusting nut 31*b* at the other end. This enables setting the tightening position for the accommodating part 21 and the tightening part 25 beforehand due to the diameter of the top region of the post 14 that is to be installed. A spring 31*c* normally urges the parts 21 and 24 apart.

The tightening screw 35 on the tightening side comprises a bolt 35*a* and a nut 35*b* on the other end. This screw is for firmly tightening the accommodating part 21 and the tightening part 25 together. A spring 35*c* urges the parts 21 and 25 apart. As shown in FIGS. 2 and 3, the top region of the upper post 14 is inserted between the accommodating part 21 and the tightening part 25 and also through the tubular shaped compressive member 40. As the accommodating part 21 and the tightening part 25 are clamped together by the tightening screws 31 and 35, the top region of the upper post 14 is held by the accommodating part 21 and the tightening part 25 through the tubular shaped compressive member 40.

The tubular compressive member 40 permits the upper post holder 20 or the seat 11 to suitably rotate with respect to the upper post 14, even when the upper post 14 may be fixed through the tightening of the accommodating part 21 and the tightening part 25. The member 40 is comprised of a synthetic resin, like nylon or of rubber, etc. that has suitable elasticity.

The tubular shaped compressive member 40 is held at the top region of the upper post 14. It has a cut 41 radially fully through it and over its full axial height. The cut 41 makes it easier for the holding and compressive clamping of the member 40 to the top region of the upper post 14. In this example, the cut 41 extends through the axial direction of the tubular compressive member 40 on that radial side of the tubular shaped compressive member 40 that is between and that does not contact the accommodating part 21 or the tightening part 25 of the upper post holder 20. The compressive member is pressed around the peripheral surface of the top region of the upper post 14 by clamping of the parts 21 and 25 by the tightening screws 31 and 35. Even when it has been fixed by tightening, the tubular shaped compressive member 40 is capable of sliding (rotating) around the top region of the post 14 when the seat 11 rotates with respect to the upper post 14.

Figure 6:
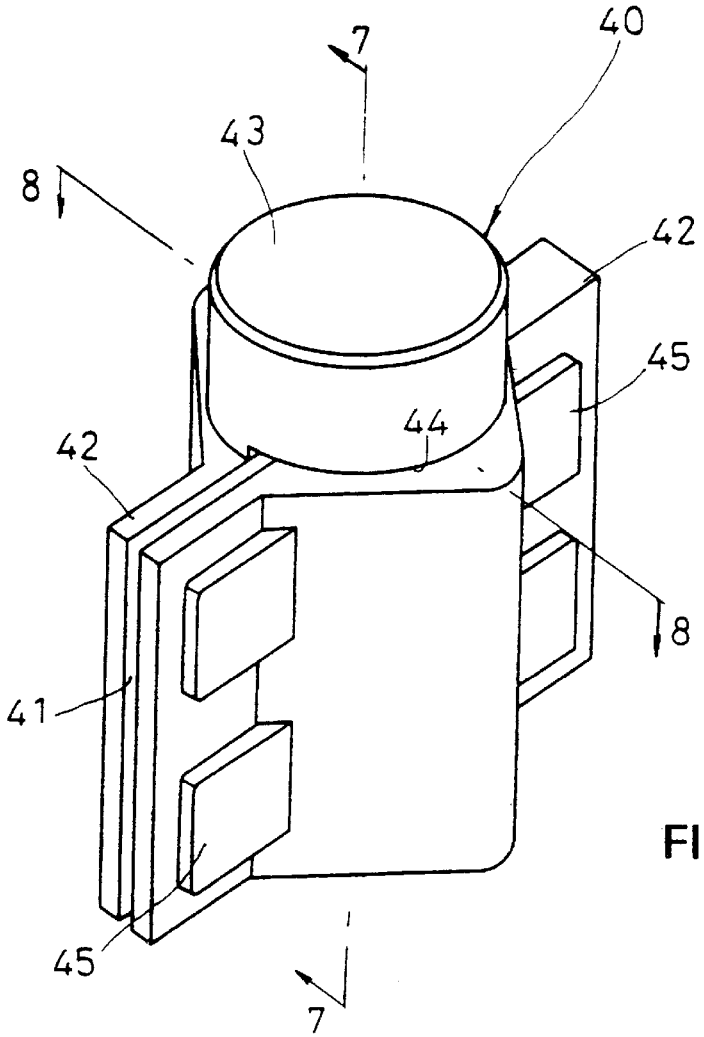
FIG. 6 is an oblique view of a compressive member used with the invention and having a tubular shaped central region.
Figure 7:
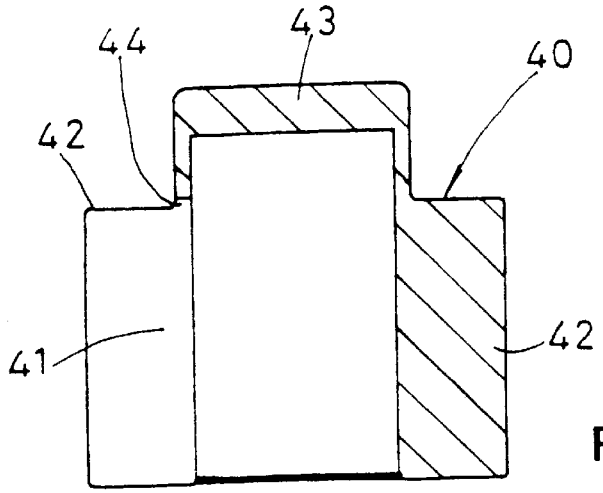
FIG. 7 is a cross-section along line 7—7 in FIG. 6.
Figure 8:
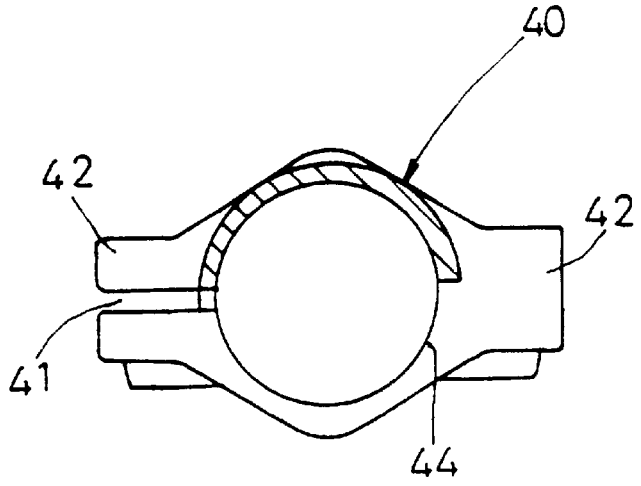
FIG. 8 is a cross-section along line 8—8 in FIG. 6.

FIGS. 6 through 8 show that the tubular compressive member 40 in this example has an outer shape that generally conforms to the cooperating opposed inner surfaces of the accommodating part 21 and the inner surface of the tightening part 25 of the upper post holder 20. It further has a projection 42 which is inserted into the gap G between the parts 21 and 25 of the upper post holder 20 at tightening and fixing on the side of the tubular shaped compressive member 40.

The projection 42 prevents the tubular shaped compressive member 40 from rotating relative to the accommodating part 21 and the tightening part 25 of the upper post holder 20 when the seat 11 rotates with respect to the upper post 14. Therefore, rotation and sliding takes place as the inner surface of the tubular shaped compressive member 40 slides on the surface of the upper post 14 without fail.

The tubular shaped compressive member 40 integrally includes a radially inner top part 43 that receives the upper terminal face of the upper post 14. The tubular shaped compressive member 40 is held in proper position at the top of the upper post 14 and there is no danger of the tubular shaped compressive member 40 falling off the post. To provide an inner top part 43 of the compressive member 40, a circumferential cut 44 is formed to extend from and half-way around the peripheral surface from the cut 41.

A suitable number of engaging protrusions 45 are provided on the outside of the tubular shaped compressive member 40 at the side of the tightening part 25 of the upper post holder 20. As the engaging protrusions 45 are inserted into the cooperating engaging concaves 27 of the tightening part 25, the tubular shaped compressive member 40 is installed at the tightening part 25 of the upper post holder 20. There may be protrusions on the compressive member that engage in concaves in the accommodating part. There may be a reversal, with concaves in the compressive member and protrusions from one or both of the accommodating and tightening parts.

This avoids the danger of loss of the tubular shaped compressive member 40 by its slipping off the upper post holder 20 when the upper post 14 is taken out of the upper post holder 20 for the purpose of transporting the chair 10.

The tubular shaped compressive member 40 need not be installed on the tightening part 25 of the upper post holder 20. The engaging protrusions can instead be provided on the side of the accommodating part of the upper post holder at the outer side of the tubular shaped compressive member. Those engaging protrusions can be inserted into engaging concaves that are provided on the compressive member. The tubular shaped compressive member can be installed on the accommodating part of the upper post holder (not shown in the drawing).

Figure 9:
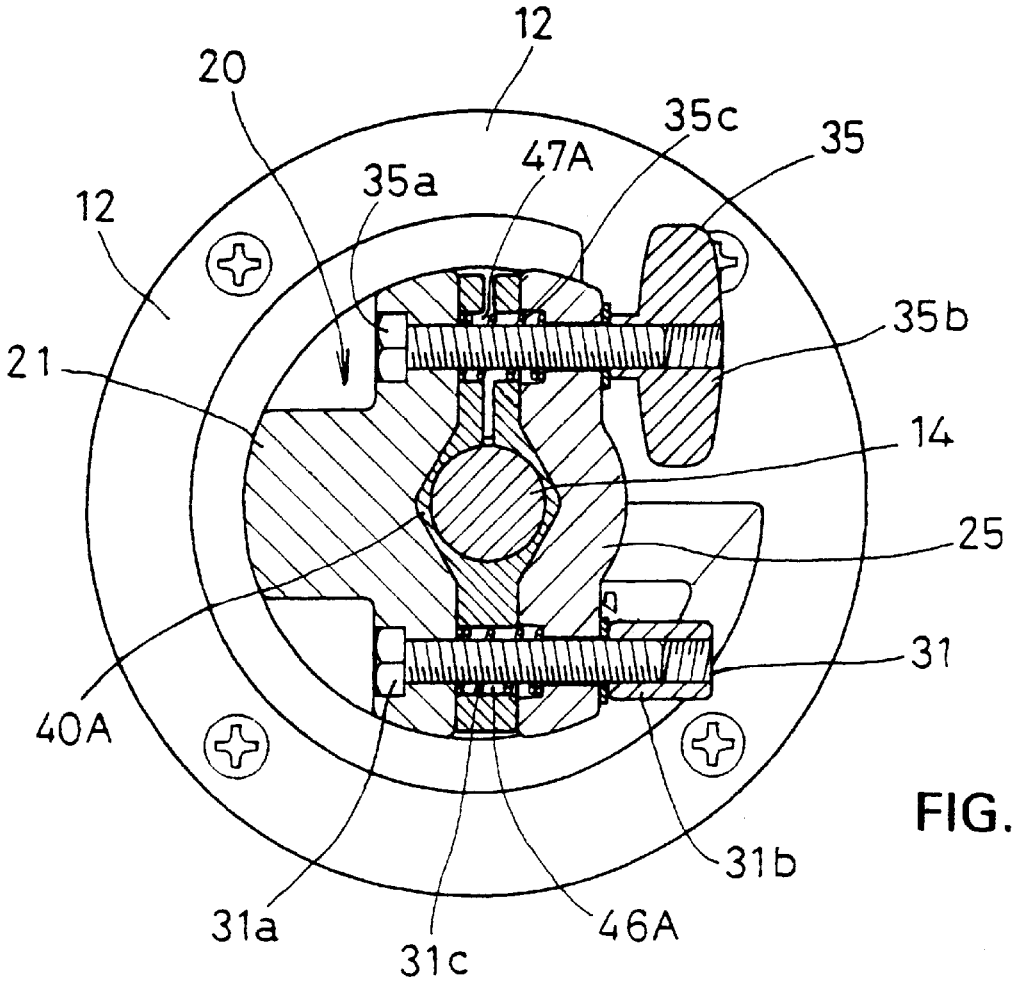
FIG. 9 is a transverse cross-section through the region below the seat showing the essential part of another embodiment of a drum chair according to the invention.

In an alternate embodiment shown in FIG. 9, the tubular shaped compressive member 40A has radial arms long enough to engage the bolts 31*a* and 35*a* or the springs 31*c* and 35*c* of the tightening screws 31 and 35.

In FIG. 9, there is an insertion hole 46A for the tightening screw on the fixed side formed in the tubular shaped compressive member 40A. An insertion hole 47A is provided for the tightening screw on the tightening side. Those parts which are the same as in FIGS. 1 and 8 have the same numbers.

Figure 10:
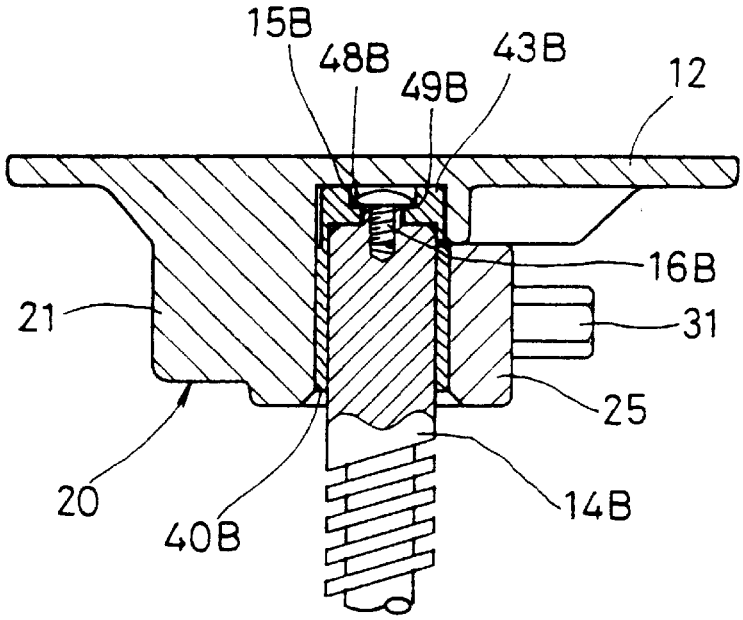
FIG. 10 is a vertical cross-section showing the essential part of that drum chair embodiment.

The tubular shaped compressive member 40B in FIG. 10 may be installed freely rotatably at the top region of the upper post 14B. The member 40B is held at the top of the upper post 14B. An installation convex 15B provided at the top of the upper post 14B may be inserted into an opening 48B having a step part 49B. The step is formed in the inner bottom 43B of the tubular shaped compressive member 40B. A screw 16B is screwed into the installation convex 15B of the upper post 14B until the screw head touches the step part 49B of the opening 48B of the said tubular shaped compressive member 40B. This freely rotatably installs the tubular shaped compressive member 40B at the top of the upper post 14B. In FIG. 10, members which are the same as in FIGS. 1 through 8 have the same numbers.

In FIG. 1, the lower post 50 has an inner tubular part 51 for holding the leg part 60 and for receiving the inserted upper post 14. The upper post is secured so that its length is freely adjustable in a telescoping manner with respect to the lower post. A nut 52 for post height adjustment is provided at the top of the inner tubular part 51. The inner peripheral surface of the nut 52 has a screw thread (not shown) that engages the screw thread 14*a* on the outer surface of the upper post 14. As the upper post 14 is rotated, it either enters or exits the part 51 while engaging the nut 52 so that the length of the upper post 14 or the height of the chair 10 as a whole may be adjusted.

The height of the chair 10 is fixed by securing the upper post 14 in position inside the lower post 50 by a tightening member 53 on the lower side of the nut 52.

A compressive member (not shown) comprised of nylon, etc. is fixed to the inside of the tightening member 53. As that compressive member is compressed by the tightening bolt 54, the upper post 14 is clamped against and fixed in the lower post 50. The height of the drum chair 10 is adjusted by loosening the tightening bolt 54 for releasing the fixing of the upper post 14 in the lower post 50, rotating the seat 11 to raise or lower the seat surface 13 to a desired height, and tightening the bolt 54 again, thereby securing the height of the upper post 14 in the lower post 50.

The leg part 60 is comprised of a plurality of legs 61. The tops of the legs 61 are fixed to the tightening member 53 of the lower post 50. In addition, the lower end regions of the legs 61 are attached freely rotatably at the lower ends of the lower post 50 through an installation ring 62 that freely slides on the lower post 50. As the installation ring 62 is moved up and down along the lower support 50, the legs 61 are collapsed inward closed or swing out and open apart, thereby erecting or folding the chair 10. A tightening bolt 55 fixes the installation ring 62.

Figure 11:
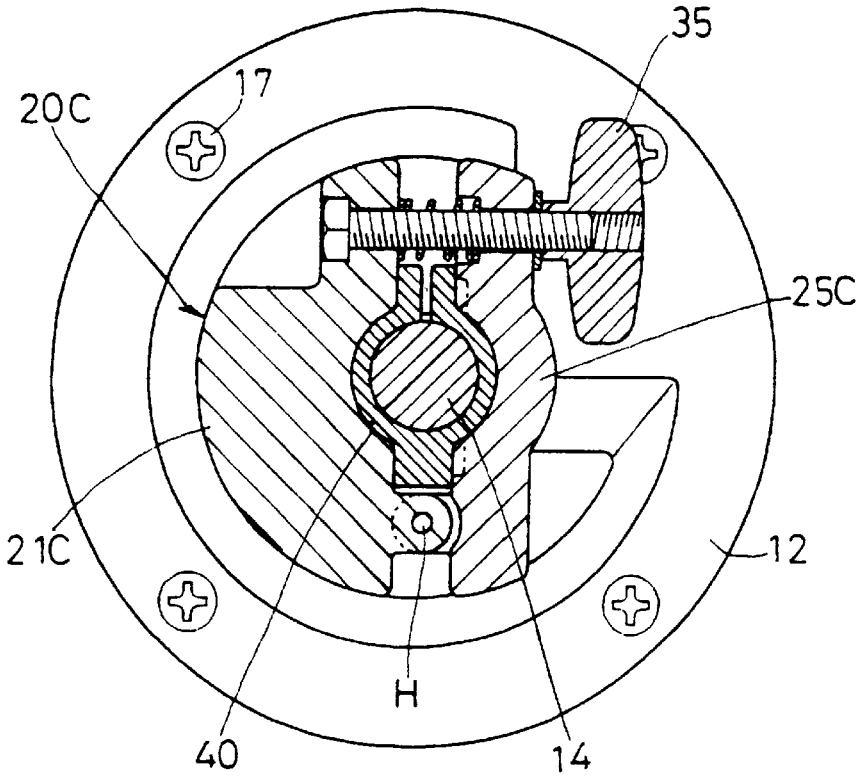
FIG. 11 is a transverse cross-section through still another embodiment of a drum chair of the invention.
Figure 12:
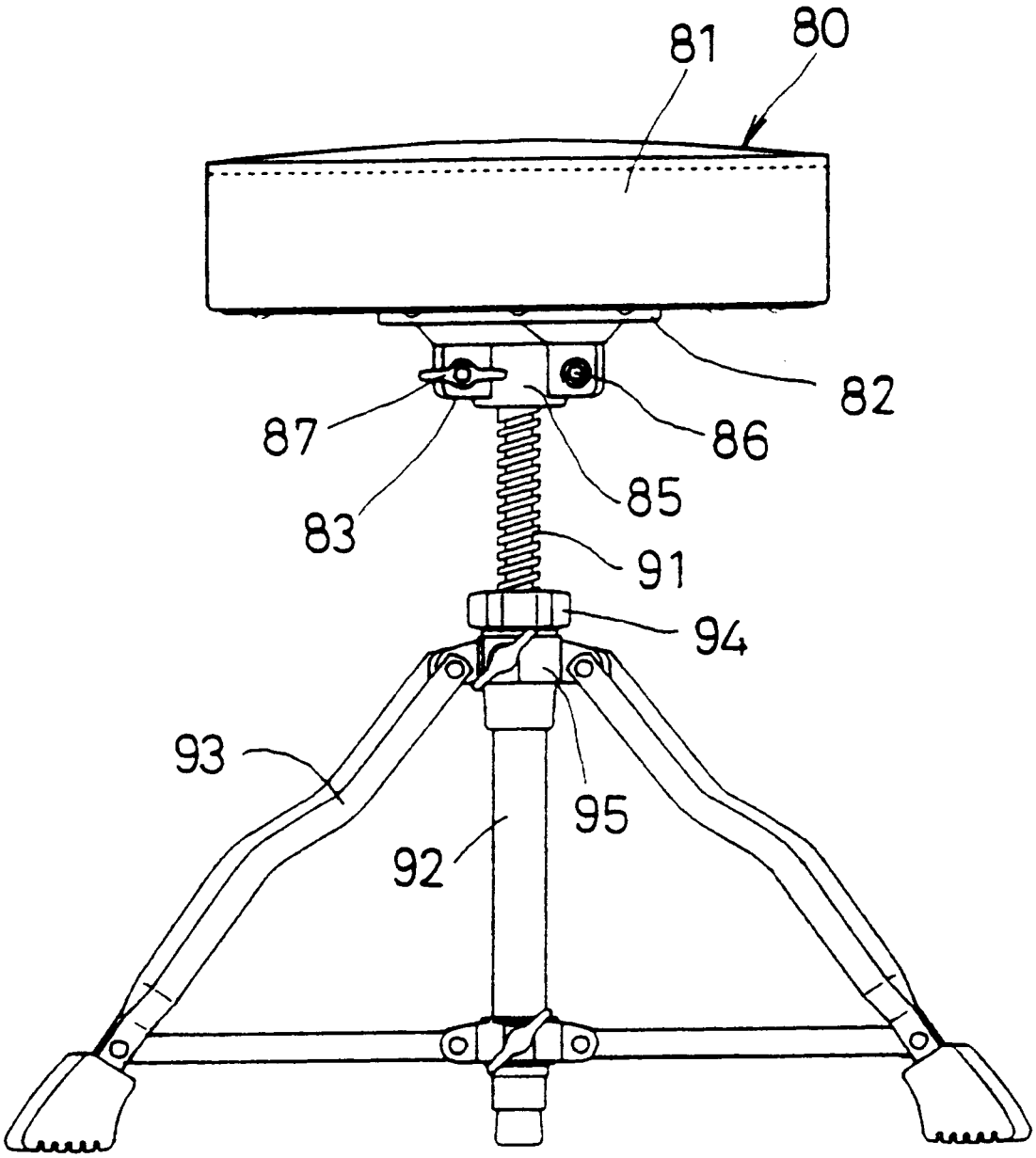
FIG. 12 PRIOR ART
FIG. 12 is a front view showing a drum chair according to prior art.
Figure 13:
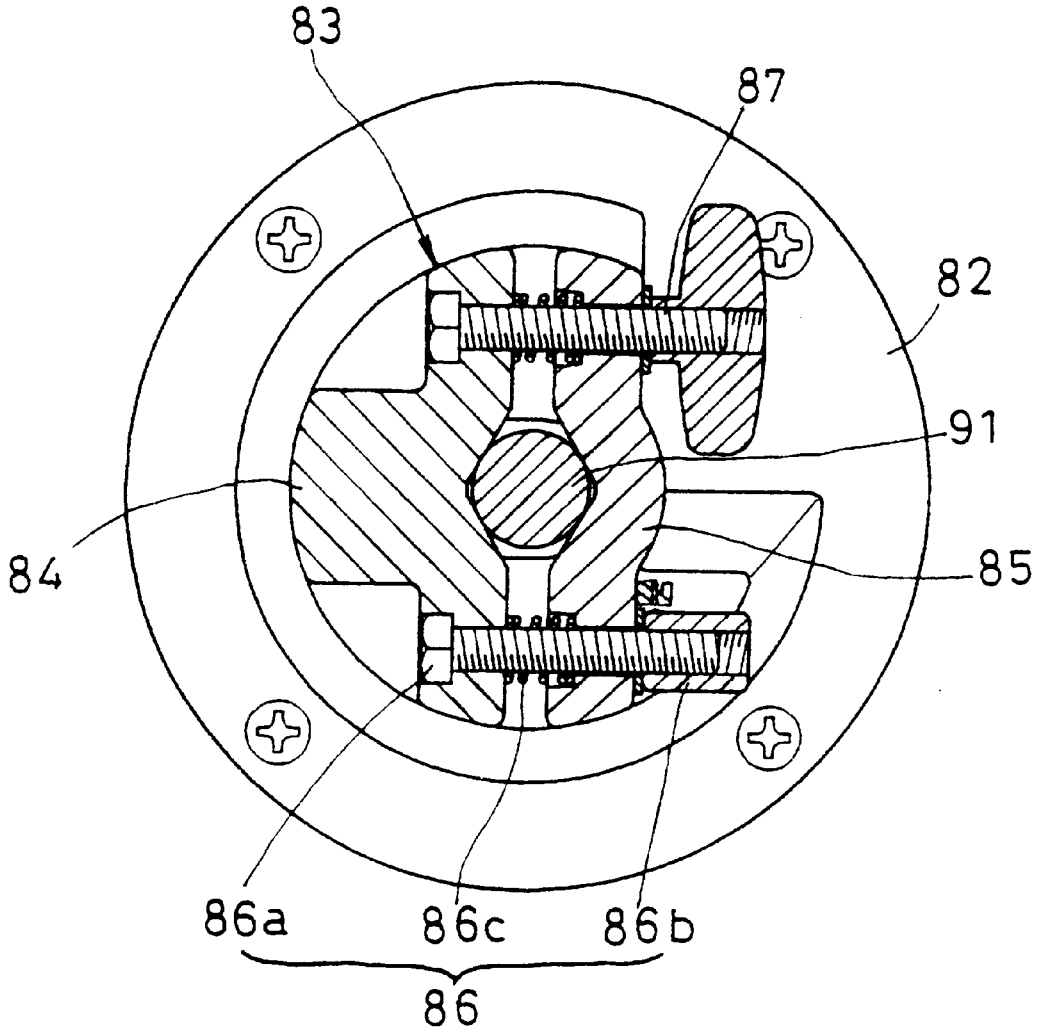
FIG. 13 PRIOR ART
FIG. 13 is a cross-section showing an essential part of that prior art embodiment.

In the above examples, the tubular shaped compressive members 40, 40A or 40B can be taken out of the upper posts 14 and 14B. As the compressive members 40, 40A and 40B are taken out and as the tightening screw 31 on the fixed side is adjusted, the seat 11 can be installed even on an upper post having a different diameter. To reduce the number of parts or make the structure simpler, as shown in FIG. 11, the tightening screw member on the fixed side may be omitted. Instead the tightening part 25C is there hinged to the accommodating part 21C of the upper post holder 20C through the hinge H.

In the above case, the tubular shaped compressive member 40 is not to be removed from the top of the upper post 14, and the choice of the diameter of the top part of the upper post is restricted. Again, members which are the same as in FIGS. 1 through 8 have the same reference numbers.

According to the holder of a post for a drum chair, the tightening screw that fixes the seat plate is not loosened due to movement of the performer who sits on the seat surface or due to the vibrations of the drum, etc., despite the simple structure. This makes it possible to prevent shakiness from developing in the chair. At the same time, the seat may rotate with the movement of the performer during a performance.

Moreover, as the seat rotates while the tubular shaped compressive member slides against the top region of the upper post, there is a certain degree of resistance to rotation. The chair can rotate even without the application of a large force when the performer moves, but the chair does not rotate past the point to which the performer moves and does not rotate when the performer does not move.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A holder for a seat post for a chair, the holder comprising:

a seat having a seat plate with an underside; a post holder attached to the underside of the seat plate;

a post for the seat plate; the post having a top and an adjacent top region; legs connected with the post for supporting the post and the chair;

the post holder comprising an accommodating part located at one side of the top region of the post, a tightening part located at an opposite side of the top region of the post and slightly spaced away from the accommodating part, and tightenable elements between the accommodating part and the tightening part for clamping them against the top region of the post;

a compressive member of a compressible material located at the top region of the post and separating the top region of the post from the accommodating part and the tightening part, such that tightening together of the accommodating part and the tightening part clamps the compressive member against the post and such that relative rotative motion of the scat with respect to the post is enabled by sliding with respect to the compressive member.

2. The holder of claim 1, wherein the compressive member is generally tubular shaped around the top region of the post and includes a cut radially into and through and extending along the height of the compressive member, such that tightening together of the accommodating part and the tightening part compresses the compressive member, and the cut in the compressive member permits the compressing.

3. The holder of claim 2, further comprising rotation preventing elements on the compressive member for cooperating with at least one of the accommodating part and the tightening part for preventing the compressive member from rotating with respect to the accommodating and tightening parts.

4. The holder of claim 3, wherein the rotation preventing elements which prevent rotation of the compressive member comprises a radial projection between the compressive member and at least one of the accommodating part and the tightening part.

5. The holder of claim 4, wherein the radial projection of the compressive member extends past and is passed through by the screw.

6. The holder of claim 4, wherein the tightenable elements for clamping the accommodating part and the tightening part against the top region of the post comprises a tightening screw extending between the accommodating and tightening parts and the tightening screw being such that tightening of the tightening screw draws the tightening and accommodating parts together.

7. The holder of claim 6, wherein the tightenable elements comprises two of the tightening screws between the accommodating part and the tightening part, with a respective one of the tightening screws located at each side of the top region of the post and both tightening screws extending across the space between the accommodating part and the tightening part.

8. The holder of claim 7, further comprising whereby each tightening screw and the respective nut cooperate enabling clamping of the accommodating part and the tightening part together.

9. The holder of claim 6, wherein the tightenable elements comprise a hinge connection between the accommodating part and the tightening part located at one side of the top region of the post and the tightening screw located at an opposite side of the top region of the post.

10. The holder of claim 2, further comprising a circumferential cut in the compressive member extending from the cut radially into the compressive member to about half-way around the compressive member.

11. The holder of claim 1, wherein the compressive member is comprised of a synthetic resin material or rubber.

12. The holder of claim 1, wherein the post comprises an upper post beneath the seat plate and a lower post beneath and supporting the upper post, and the upper and lower posts being relatively telescopable for adjusting the height of the seat; and the legs being on the lower post.

13. The holder of claim 1, wherein the compressive member has a terminal face portion which extends over and is contacted by the top of the post when the post is installed in the post holder.

14. The holder of claim 1, in which the compressive member is installed on the post holder.

15. The holder of claim 1, wherein the compressive member is installed on the top region of the post.

* * * * *